United States Patent [19]

Wild

[11] Patent Number: 5,020,502

[45] Date of Patent: Jun. 4, 1991

[54] METHOD AND CONTROL DEVICE FOR CONTROLLING THE AMOUNT OF FUEL FOR AN INTERNAL COMBUSTION ENGINE

[75] Inventor: Ernst Wild, Oberriexingen, Fed. Rep. of Germany

[73] Assignee: Robert Bosch GmbH, Stuttgart, Fed. Rep. of Germany

[21] Appl. No.: 477,924

[22] PCT Filed: Dec. 9, 1988

[86] PCT No.: PCT/DE88/00754

§ 371 Date: Jun. 21, 1990

§ 102(e) Date: Jun. 21, 1990

[87] PCT Pub. No.: WO89/06310

PCT Pub. Date: Jul. 13, 1989

[30] Foreign Application Priority Data

Jan. 7, 1988 [DE] Fed. Rep. of Germany ..... 3800176

[51] Int. Cl.[5] ..... F02D 41/14; F02D 41/40

[52] U.S. Cl. ..... 123/489; 364/431.05

[58] Field of Search ..... 123/440, 489, 589, 480, 123/486; 364/431.05

[56] References Cited

U.S. PATENT DOCUMENTS 4,467,770 8/1984 Arimura et al. ..... 123/489
4,483,300 11/1984 Hosaka et al. ..... 123/489
4,627,402 12/1986 Saito et al. ..... 123/489 X
4,703,430 10/1987 Amano et al. ..... 123/489 X
4,766,870 8/1988 Nakajima et al. ..... 123/489
4,869,222 9/1989 Klassen ..... 123/489
4,934,328 6/1990 Ishii et al. ..... 123/489
4,939,658 7/1990 Sekozawa et al. ..... 123/489 X
4,962,741 10/1990 Cook et al. ..... 123/489

*Primary Examiner*—Willis R. Wolfe
*Attorney, Agent, or Firm*—Walter Ottesen

[57] ABSTRACT

A control device for controlling the quantity of fuel which is supplied to the cylinders of an internal combustion engine by means of an injection device at each cylinder exhibits a precontrol timer 10, an individual-value memory 11 and a logic device 12. The individual-value memory stores individual values which are provided to the injection devices for the individual cylinders of an internal combustion engine 13. The logic device logically combines the individual values with a precontrol time provided by the precontrol timer, in such a manner that such a control time is obtained for each injection device that the lambda values individually measured for each cylinder by a lambda probe in the exhaust gas are essentially equal for all cylinders. It is possible to achieve very advantageous exhaust gas values with such a control device.

8 Claims, 2 Drawing Sheets

FIG. 1
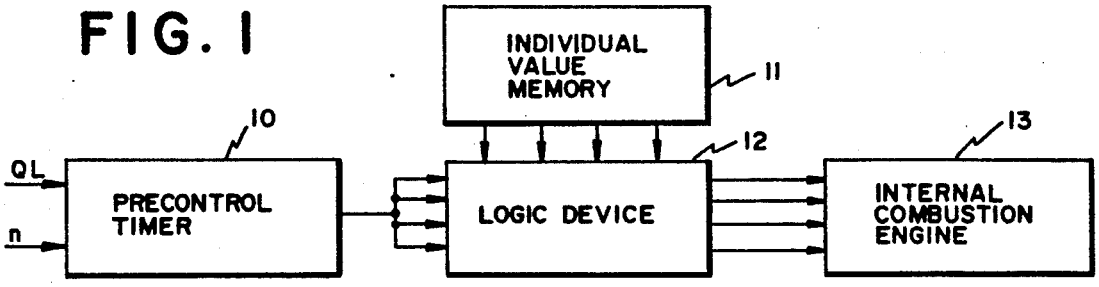
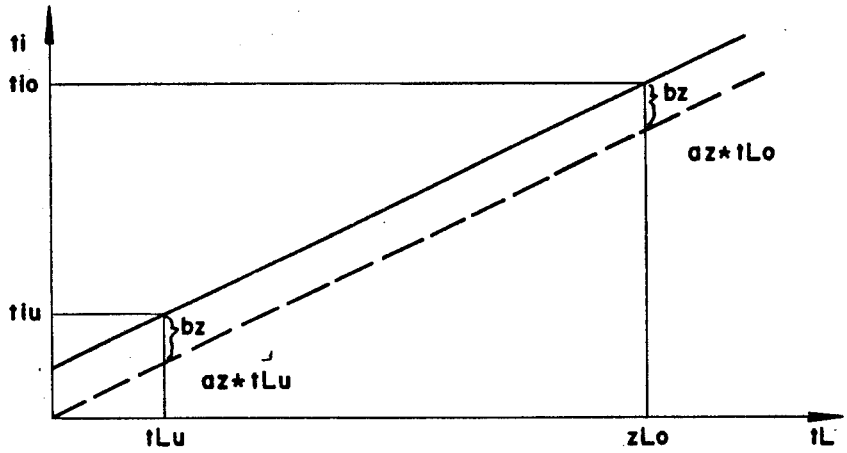
FIG. 2
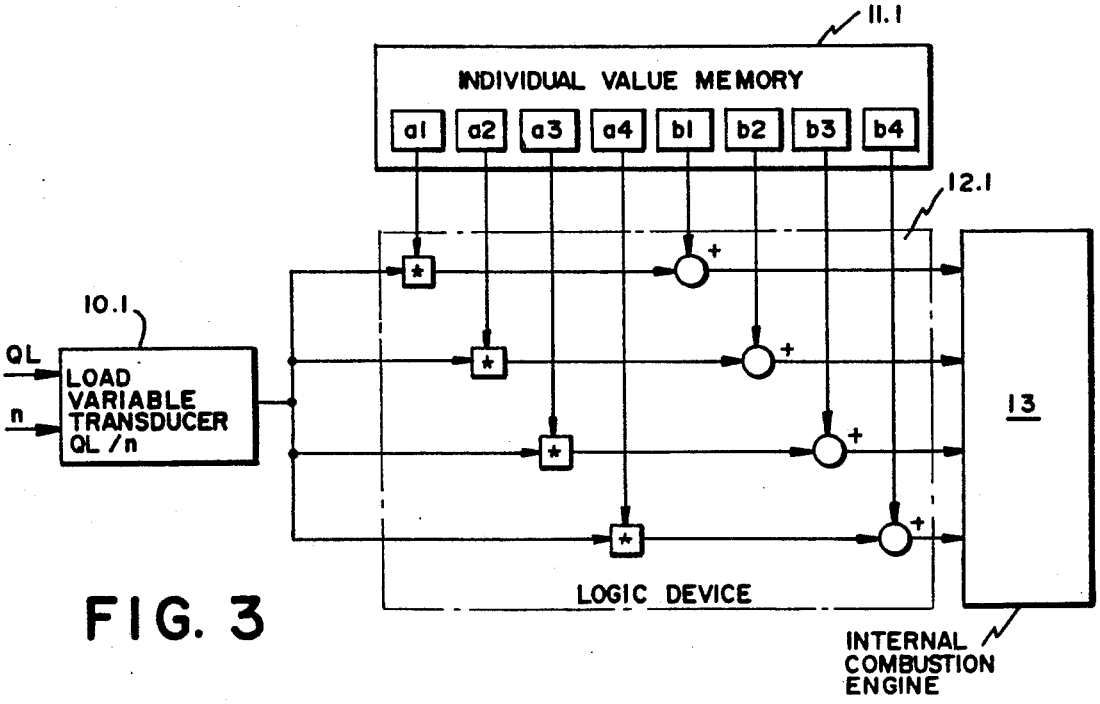
FIG. 3

METHOD AND CONTROL DEVICE FOR CONTROLLING THE AMOUNT OF FUEL FOR AN INTERNAL COMBUSTION ENGINE

FIELD OF THE INVENTION

The invention relates to a method for controlling the quantity of fuel metered individually to each cylinder of an internal combustion engine by means of an injection device, and a device for carrying out this method.

BACKGROUND OF THE INVENTION

A known control device exhibits a precontrol timer which outputs precontrol times in dependence on rotational speed and quantity of air drawn in with a particular precontrol time applying jointly to all injection valves. A lambda control operating uniformly on all cylinders is superposed on the precontrol.

In the known control device it is a problem that variations in characteristics of the different cylinders are not taken into consideration, which can lead to an individual cylinder of the internal combustion engine delivering an exhaust gas which is relatively rich in pollutants. It has been attempted up till now to keep the cylinder variations small, particularly by designing the internal combustion engine in such a manner that very similar conditions prevail in all gas paths.

A development of such a control device is disclosed in U.S. Pat. No. 4,483,300.

This control device determines a pulse time, which is effective individually for each cylinder, for metering fuel for each cylinder based on variables which are the same for each cylinder. The control device also determines multiplicative correction factors which are specific for each cylinder.

SUMMARY OF THE INVENTION

The invention is based on the object of providing a method and a control device of the type initially mentioned which has a compensating effect with respect to cylinder variations. The invention is also based on the object of providing a method for adjusting parameters of such a device.

The method according to the invention is characterized by the fact that it compensates variations in the characteristics of the different cylinders of an internal combustion engine by modifying the known precontrol by means of individual correction values which are formed from a combination of individual factors and individual summands. Thus, the injection devices are not all driven with the same injection time but the precontrol time for each cylinder is corrected in such a manner that the exhaust gas from all individual cylinders essentially exhibits the same composition.

The method according to the invention is further characterized in that a determination is made for which cylinder the lambda value measured in the exhaust gas deviates from a predetermined value and then the corrective value or values for this cylinder are changed until the pregiven lambda value results.

In order to store the individual correction values, the device according to the invention has an individual-value memory. A logic device logically combines the common precontrol time with the individual correction values.

If a lambda probe is used for the measurement which measures from the rich to the lean range without jump characteristics, for example a probe of the pump current type with essentially linear characteristic, there are relatively few problems in detecting deviations from lambda = 1 and setting to lambda = 1. However, considerable complexity is required in processing the signal from the probe as such probes are relatively sensitive not only to fluctuations of the exhaust gas composition but also to pressure fluctuations. Nernst-type probes present fewer problems with respect to the latter. It is also recommended to use these probes because the probe frequently already installed in the vehicle, which, as a rule, is a Nernst-type probe, can then be used as measuring probe. When such a probe type is used, a method by successive approximation is proposed. In this method, the injection time is changed in such a manner that, for example, a distinctly lean exhaust gas should be achieved. If this is not the case, this indicates a deviation of the characteristics of the cylinder monitored from the characteristics of the other cylinders in the direction of a rich setting, to an extent which must be compensated in accordance with the change effected in the injection time. After this compensation, a change is carried out for achieving a rich mixture. These alternating changes are repeated with lower and lower amplitude until a predetermined minimal amplitude is reached.

BRIEF DESCRIPTION OF THE DRAWINGS

Embodiments of the invention are explained in greater detail in the description following and are shown in the drawing, in which:

FIG. 1 shows a block diagram of a control device comprising an individual-value memory and a logic device;

FIG. 2 shows a diagram for explaining the relationship between a load variable tL and the injection time ti;

FIG. 3 shows a block diagram of a control device comprising an individual-value memory which stores individual factors and individual summands, and a logic device which multiplies and adds; and, FIG. 4 shows a block diagram of a control device and of a test device wherein the control device has an individual-value memory with individual factors which can be varied with the aid of the test device.

DESCRIPTION OF THE PREFERRED EMBODIMENTS OF THE INVENTION

Figure 4:
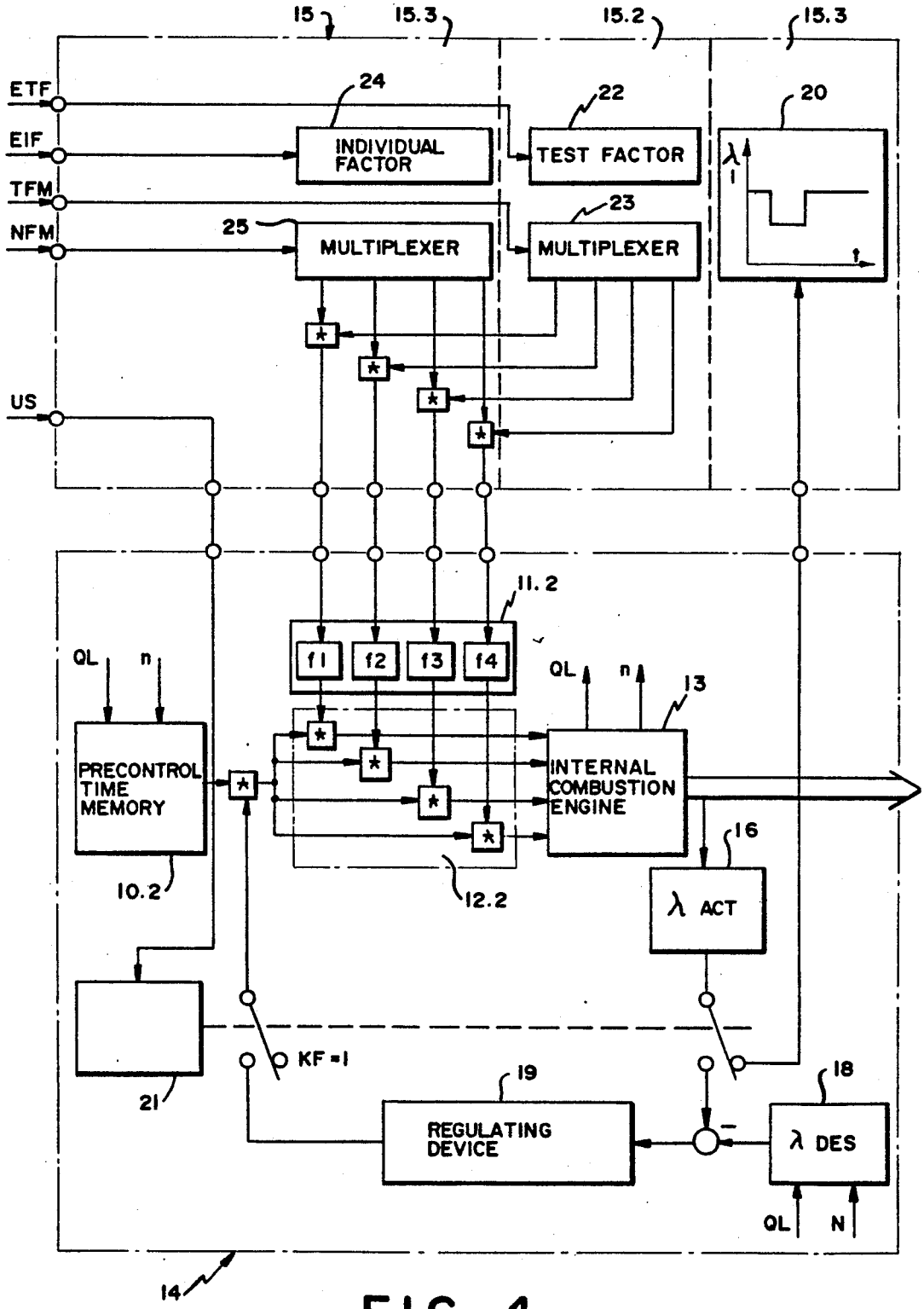

The control device according to FIG. 1 has a precontrol timer 10, an individual-value memory 11 and a logic device 12 which outputs corrected precontrol times to injection devices (not shown) in an internal combustion engine 13. The precontrol timer 10 is driven by means of a signal which is proportional to the rotational speed n, and a load-indicating signal which is identified with QL in FIG. 1, corresponding to a measured quantity of air per unit time. However, the load signal can also be determined, for example, by the intake pressure or the throttle flap position. Apart from these input variables, conventional precontrol timers frequently also take into consideration other quantities, particularly the engine temperature, but this is of no importance to the explanations following. The logic device 12 logically combines precontrol times output by the precontrol timer 10 with correction values which are read out of the individual-value memory 11. These correction values are separately determined for each injection device of the internal combustion engine 13 in such a manner that in each case such a control time is obtained for each injection device that the lambda values measured individually for each cylinder by means of a lambda probe in the exhaust gas are essentially equal for all cylinders.

Before discussing details of the invention in greater detail, FIG. 2 will first be used to explain how cylinder variations can be generally compensated for.

In FIG. 2, the relationship between the injection time ti for a single cylinder and a load variable TL common to all cylinders is shown. The load variable TL is obtained, for example, by dividing the air quantity WL per unit time by the rotational speed n and multiplying the result by a constant which adjusts the result of the division in such a manner that a time is obtained which is within the range of conventional injection times of a few milliseconds. The load variable tL is thus a preliminary injection time.

So that the exhaust gas from a single cylinder exhibits the same lambda value, for example lambda = 1, in all operating conditions, the injection time ti must vary proportionally to the air quantity QL per unit time and inversely proportionally to the rotational speed n, that is, overall, proportionally to the load variable tL. This is shown by the dashed line in FIG. 2. The dashed line shows the following relationship:

$$ti = az * tL,$$

where az is an individual factor which holds for the cylinder z. This factor is only equal for all cylinders if all injection devices deliver exactly the same quantity of fuel within the same injection time and if exactly the same quantity of air per unit time passes through all cylinders in each case. If, in contrast, one of the cylinders has an injection device which delivers, for example, 5% less fuel per unit time than the other injection devices, the factor az for the cylinder z having this injection device is to be selected higher by 5% than the individual factors for the other cylinders. Correspondingly, it is necessary to raise an individual factor by, for example, 5% if 5% more air per unit time flows through one cylinder than through the other cylinders.

In the considerations listed above, it was assumed that all injection devices constantly deliver the same fuel quantity per unit time over their entire particular drive time. However, this is not the case in practice since injection devices, for example injection valves, open more slowly than they close. This fact must be taken into consideration by an additional time, an individual summand bz. This results in the following relationship in accordance with the continuous straight line in FIG. 2:

$$ti = az * tL + bz.$$

This equation, which holds true for each cylinder z contains two unknown, namely the individual factor az and the individual summand bz. In order to be able to determine these individual values, the values ti and tL must be determined for two points on the function line, namely for a lower and an upper point, preferably for idling and for full load in the present case. This results in the following two equations:

$$tiu = az * tLu + bz \quad (1)$$

$$tio = az * tLo + bz \quad (2)$$

Subtracting equation (1) from equation (2) and evaluating with respect to az results in:

$$az = (tio - tiu)/(tLu - tLo) \quad (3)$$

The following is then obtained from equations (1) and (3) for the individual summand bz:

$$bz = tiu + tLu * (tio - tiu)/(tLu - tLo) \quad (4)$$

The values thus obtained are stored in an individual-value memory which is a part of the control device shown in FIG. 3 and is there identified with 11.1. The control device also has a load variable transducer 10.1 and a logic device 12.1. The load variable transducer 10.1 forms the quotient QL/n and also multiplies by a factor in such a manner that a load variable is obtained in the sense of a preliminary injection time as explained above. This load variable is multiplicatively multiplied in the logic device 12.1 with one individual factor a1, a2, a3 or a4 and a corresponding individual summand b1, b2, b3 or b4 is added by means of a summing element corresponding thereto. As a result, individual injection times pass to corresponding ones of the injection devices at each of the cylinders of an internal combustion engine 13.

A simpler configuration of an individual-value memory and of a logic device is obtained if it is not intended to take into consideration variations due to aging in the summand described. This results in a configuration which is a part of the block diagram of FIG. 4.

In the block diagram according to FIG. 4, a control device 14 and a test device 15 are present and both are indicated by framing with dot-dashed lines. Initially, only the control device 14 is of interest. This device has as control device a precontrol-time memory 10.2, an individual-value memory 11.2 and a logic device 12.2. In the individual-value memory 11.2, only individual factors f1, f2, f3 and f4 are stored. To obtain these factors, it is no longer necessary to carry out two measurements as explained above with reference to equations (3) and (4) but one measurement is sufficient, for example that according to equation (3), the summand bz being set to zero and a factor fz standing for the factor az.

In the precontrol-time memory 10.2, precontrol times are addressably stored which can be addressed via values of the air quantity QL and the rotational speed n and under certain circumstances, via further operating variables (not shown). The logic device 12.2 multiplies a precontrol time which is common to all cylinders by an individual factor f1, f2, f3 and f4 and supplies the thereby individualized control times to the particular associated injection device in the internal combustion engine 13. If the precontrol times have been correctly determined for all operating conditions and there are no changes due to aging in the variations of the above-mentioned summands bz, it is unimportant for the accuracy of the correction that the summands in the control device are not separately taken into consideration in the control device 14. It is sufficient to determine the individual factors fz from time to time new.

Apart from the precontrol, the control device 14 according to FIG. 4 also has a superposed control system. The control system is of no significance to the invention and will be described only briefly here since it represents the usual design of control devices. Namely, another lambda probe 16 is arranged in the exhaust gas stream 17 of the internal combustion engine 13. This probe has an actual lambda value which is subtracted from a desired lambda value. The desired value is read out of a desired-value memory 18 which is addressable via the operating variables which were mentioned in the description of the precontrol-time memory 10.2. The control deviation thus formed is supplied to a regulating device 19 which outputs a correction factor KF, by means of which the precontrol time read out of the precontrol-time memory 10.2 is corrected by multiplication in such a manner that the control deviation should disappear. Such a control superposed on the precontrol can be used not only with the embodiment of a control device according to FIG. 4 but in conjunction with any arbitrary control device according to the invention as in FIG. 1.

It has been mentioned above that the relationship shown in FIG. 2 only holds true if a particular lambda value is kept constant within the entire load range. In the text which follows, it is described on the basis of FIG. 4 how the lambda value can be adjusted and how the individual values can be determined.

The test device 15 according to FIG. 4 is used for carrying out the measures just mentioned. This device is subdivided into three sections, namely a measuring section 15.1, a test section 15.2 and a programming section 15.3. The measuring section 15.1 has a display device 20 for displaying the lambda value measured in the exhaust gas stream 17. In order that this lambda value is no longer given to the subtracting element for forming the control deviation for the regulating device 19 but reaches the display device 20, the control device 14 has a change-over switch 21 which carries out an appropriate switch-over operation following a switch-over signal US from the test device 15. At the same time, the output signal from the regulating device 19 is interrupted and, instead, a constant correction factor KF = 1 for multiplying by precontrol times is outputted.

The test section 15.2 has a test factor adjusting device 22 and a test factor multiplexer 23. Correspondingly, the programming section 15.3 has an individual-factor adjusting device 24 and an individual-factor multiplexer 25. Each of four output lines of the multiplexer is connected to a register in the individual-value memory 11.2 which stores a corresponding individual factor.

It is assumed that the lambda value is measured by means of a lambda probe having a linear output signal and that all adjusting processes are effected manually.

Initially, all individual factors f1, f2, f3 and f4 in the individual-value memory 11.2 are set to the initial value 1 via the individual-factor multiplexer 25. Then the display device 20 is observed to see whether there is a deviation from lambda = 1. If such a deviation exists, for example in the direction of rich as shown in FIG. 4, a test factor of 0.8 is individually supplied cylinder by cylinder to the relevant register in the individual-value memory 11.2 via the test factor multiplexer 23. The content of the other registers is set to 1 via the individual-factor multiplexer 25. Multiplying a precontrol value by the value 0.8 leads to the lambda value being displaced in the direction of lean. As soon as the register associated with the cylinder which triggered the deviation in the direction of rich on the display device 20 is driven with the factor of 0.8, this deviation disappears.

After a deviating cylinder has been found in this manner, the individual factor 1 is also established again for this cylinder. The lambda value for this cylinder, for example 0.95, is then measured on the display device. Exactly this value is then adjusted from the outside as individual factor in the individual-factor setting device 24 via a signal EIF and the individual-factor multiplexer 25 is driven by a signal NFM in such a manner that it writes the factor 0.95 in the individual-value memory 11.2 exactly into the register responsible for the cylinder found. This measure ensures that the cylinder concerned no longer deviates in the direction of rich compared with the other cylinders.

Using a lambda probe having a linear characteristic has the advantage that lambda values can be directly read off. However, an accurate indication is ensured only if signal disturbances caused by pressure fluctuations in the exhaust gas are compensated by measuring techniques, which is expensive. Previous probes having a linear measuring characteristic are very sensitive to such pressure fluctuations. A further disadvantage in the use of such probes is that it is not possible to use an installed lambda probe directly since, in accordance with the present state of the art, such a probe is usually a probe of the Nernst type with jump characteristics between the rich range and the lean range. The text following explains the method according to the invention using such a probe, also on the basis of FIG. 4.

Initially, all individual factors are again set to 1 in the individual-value memory 11.2 via the individual-factor multiplexer 25. Then a common test factor of 0.8, which should lead to a lean signal for all cylinders, is output via the test factor multiplexer 23. If this is the case, a test factor of 1.2 is output. The consequence should be a rich signal for all cylinder. If this is also the case, the test factor is changed to 0.85. If then a cylinder indicates a rich signal, this means that this cylinder is running in the direction of rich by 15% in comparison with the other cylinders. Which cylinder is triggering the signal is determined by the fact that each cylinder is supplied in turn with the test factor of 0.8 while the other cylinders still receive the factor 0.85 as before. If the rich signal disappears, this is a sign of the fact that the cylinder which triggered the signal has just been driven. The individual factor 0.85 is then set for this cylinder in the individual-factor setting device 24. If the test factor is changed in further steps, it is given to the associated register in the individual-value memory 11.2, multiplied by the individual factor set for the cylinder concerned.

The steps described are repeated until the test factors for rich and lean only exhibit a predetermined deviation of 1, for example 2%.

It is pointed out that the test factor, instead of being connected to a device which performs a multiplicative combination with the individual factor, could also be connected to the line for the correction factor KF which in any case leads to a logic device acting multiplicatively.

The two methods described are applicable not only to the control device according to FIG. 4 which only stores individual factors fz but also to the embodiment of the control device according to FIG. 3, which stores individual factors az and individual summands bz. The summands bz are then set to zero in the individual value memory. Lambda = 1 is set by changing the factors and the associated values of load signal and injection time are measured. This is carried out for a lower and an upper load variable according to equations (3) and (4) whereupon a respective individual factor az and an individual summand bz can be calculated.

The methods have up to now been described for manual execution. The process sequences show, however, that they can be automated without problems. They can then be quickly and reliably carried out, for example during the final assembly on a conveyor of an engine production line or during customer service. The test device 15 can be constructed as a separate device or can also be accommodated in the housing which accommodates the control device. In the latter case, the individual values can be set regularly, for example after a predetermined time after the internal combustion engine has been started. However, this affords no significant advantages since the largest variations are compensated by setting during final assembly and variations due to aging only occur over relatively long periods of time.

If the above method using the successive approximation is automated, it must be monitored, as described, whether an error signal in the direction of rich occurs when actually only lean signals are expected and conversely. If it is now to be observed whether this signal disappears cylinder by cylinder during the changing of test factors, it can happen that the signal is maintained, namely if it is not only a single cylinder which exhibits a variation in the wrong direction observed, but if this is the case with two or even more adjacent cylinders. If this is found, the test factors must be jointly changed in the manner described for two adjacent cylinders and if a signal remains even then, for three adjacent cylinders and so forth. Instead, it is also possible to monitor, in addition to the amplitude, also the time duration of the error signal. If two adjacent cylinders exhibit the variation error the signal amplitude is maintained during testing-through but for only half the time as during the pre-test measurement for finding the cylinder with variation. A cylinder is then identified by observing signal amplitude and signal duration as in the manual setting.

As explained, it is possible to determine individual values in such a manner that such a control time is obtained for each injection device, that the lambda values individually measured for each cylinder by a lambda probe in the exhaust gas are essentially equal for all cylinders. If these values are stored in the individual-value memory of a control device and logically combined with a common precontrol time by means of a logic device, all cylinders essentially supply an exhaust gas having the same lambda value. This makes it possible to reduce the pollutant content for all cylinders uniformly. It is then no longer necessary, as before, for some cylinders to have to run slightly too richly and the other ones slightly too leanly only in order to obtain a satisfactory mean value.

It is pointed out that the value of the summands bz depends on the voltage with which the injection devices are driven. If a non-regulated voltage is used for this, which can thus fluctuate, each summand bz must be corrected, which is effected most suitably by multiplying it by a quantity which is proportional to the drive voltage for the injection devices.

The individual-value memory in all embodiments is most suitably constructed as PROM and, in particular, as EEPROM. If then a method for determining individual correction values is carried out in a customer service, the newly determined values can be written into the EEPROM. It is also possible to use a non-volatile RAM but a control device which contains a control device of the type described must then also contain a test device which makes it possible to automatically determine new individual correction values whenever an initialization process for memories has become necessary, and to write these correction values back into the RAM.

All memories and devices described are advantageously given by sections and functions of a microcomputer such as is widely used today in engine electronics.

I claim:

1. A method of controlling the quantity of fuel which is metered to the individual cylinders of an internal combustion engine by means of an injection device, the method comprising the steps of:

correcting precontrol times, which are common to all cylinders and dependent on rotational speed and air quantity drawn in by suction, with individual corrective values dependent upon lambda actual values;

forming the individual corrective values from a combination of individual factors (az) and individual summands (bz);

determining the cylinder for which there is a deviation of the airfuel ratio from a pregiven lambda value in the event of a deviation of the value, which is measured by the lambda probe, from a pregiven lambda value;

adjusting the desired lambda value by changing the individual factors (az);

determining the value of the injection time (tiu) corrected as may be required and belonging to the desired lambda value at (tLu);

adjusting the desired lambda value by changing the individual factors after an upper value (tLo) of the load variable occurs and in the event of a deviation of the value measured by the lambda probe from a pregiven value;

determining the value of the injection time (tio) corrected as may be required and belonging to the desired lambda value (tLo);

computing and storing the individual factor (az) and the individual summand (bz) for a specific cylinder from the equations:

$$tiu = az \times tLu + bz$$

$$tio = az \times tLo + bz$$

and, again examining the computed values for (az) and (bz) and correcting said values (az) and (bz) as may be required after the occurrence of the value (tLu) of the load variable.

2. The method of claim 1, wherein the method of determining for which cylinder the air/fuel mixture deviates from a pregiven lambda value is performed with the further steps of:

changing the injection time of all cylinders in the direction acting opposite to the observed deviation with each cylinder being taken in turn; and, observing at which cylinder the injection time has just been changed when a reduction of the deviation or a reversal thereof has occurred in the opposite direction.

3. The method of claim 1, wherein the individual factors are changed so that a lambda value of as close to one as possible is obtained when a lambda probe is used which measures from the rich into the lean range without a jump performance, the method comprising the further steps of:

measuring the lambda value; and, multiplying that individual factor on the basis of which the lambda measurement occurred by the measured lambda value.

4. Method of claim 3, wherein: when a lambda probe is used which exhibits jump characteristics on transition from the rich to the lean range, the individual factors are varied in such a manner that a lambda value of as accurately as possible one is achieved, by means of the steps below:

(a) a test factor TF having such a magnitude that a strong lean lambda value should occur, for example TF = 0.8, is superposed on the individual factor for the cylinder (z) for obtaining an injection time for the injection arrangement at the cylinder (z),
  (a1) if this is so, passing to step b,
  (a2) if this is not so, the individual factor is multiplied by the test factor for obtaining a now applicable individual factor and the method is continued as follows:

(b) a test factor TF of such a magnitude that a strong rich lambda value should occur, for example TF= 1.2, is multiplicatively superposed on the individual factor,
  (b1) if this is so, passing to step c,
  (b2) if this is not so, the individual factor is multiplied by the test factor for obtaining a now applicable individual factor, and the method is continued as follows:

(c) the magnitude of the test factor for the next lean step is varied compared with the magnitude of the test factor in the preceding lean step, in such a manner that it is closer to one,
  (c1) if the test factor TF now applicable is greater than or equal to a lean limit value, for example TF = 0.98, passing to step d,
  (c2) if the test factor now applicable is smaller than the lean limit value, terminating the method,
  (d) the test factor is multiplicatively superposed on the individual factor, which should result in a lean lambda value,
  (d1) if this is so, passing to step e,
  (d2) if this is not so, the individual factor is multiplied by the test factor for obtaining a now applicable individual factor and the method is continued as follows:

(e) the magnitude of the test factor for the next rich step is varied compared with the magnitude of the test factor in the preceding rich step in such a manner that it is closer to one,
  (e1) if the new test factor TF is less than or equal to a rich limit value, for example TF = 1.02, passing to step f,
  (e2) if the new test factor is greater, that is closer to one than the rich limit value, terminating the method,
  (f) the test factor is multiplicatively superposed on the individual factor, as a result of which a rich lambda value should occur,
  (f1) if this is so, passing to step c,
  (f2) if this is not so, the individual factor is multiplied by the test factor for obtaining a now applicable individual factor and the method is continued at step c.

5. A control apparatus for controlling the quantity of fuel which is metered to the individual cylinders of an internal combustion engine with an injection device which meters the desired quantity of fuel to each cylinder, the apparatus comprising:

precontrol time transducer means for supplying the precontrol times (TL) in dependence upon rotational speed and the air quantity drawn in by suction with the particular precontrol time applying in common for all injection valves;

individual valve memory means for storing corrective values for all cylinders individually;

a logic device for logically combining the common precontrol time with individual corrective values dependent upon lambda actual values;

means for adjusting a lower value (tLu);

means for determining a deviation of the value measured by the lambda probe from a pregiven lambda value and for detecting for which cylinder the air/fuel-ratio deviates from the pregiven lambda value;

means for adjusting the desired lambda value by changing the individual factor (az);

means for determining the injection time (tiu) belonging to the lower load variable (tLu) at the desired lambda value;

means for adjusting an upper value (tLo) of the load variable and for adjusting the desired lambda value by changing the individual factor in the case of a deviation of the value measured by the lambda probe from a pregiven lambda value;

means for determining the injection time (tio) corresponding to the upper load variable (tLo) at the desired lambda value;

means for specifying and storing the individual factors (az) and individual summands (bz), which are dependent on the lambda actual values, in accordance with the equations:

$$tiu = az \times tLu + bz$$

$$tio = az \times tLo + bz$$

means for again examining the computed values of (az) and (bz) after a renewed adjustment of the value (tLu) of the load variable and for correcting the computed values of (az) and (bz) as may be required.

6. The control apparatus of claim 5, further comprising:

a regulating device 19 which outputs an actuating signal which is superposed on the precontrol times; and, a switch-over device 21 for switching between regulating operation and setting operation, the actuating signal being switched off in the setting operation and a method for determining the individual correction values is carried out.

7. The control apparatus of claim 6, wherein said precontrol time transducer is a precontrol-time memory 10.2 for storing precontrol times for lambda values = 1, addressable via values of addressing operating variables which include the rotational speed and an operating variable which indicates the quantity of air drawn in; the individual-value memory 11.2 stores an individual factor (fz) for each cylinder (z); and, the logic device 12.2 multiplies the particular precontrol time for each injection valve, which is common to all injection valves, by the individual factor allocated to the associated cylinder.

8. The control apparatus of claim 6, wherein said precontrol-time memory means is a load variable transducer 10.1 which outputs a load variable QL/n which is proportional to the quotient of air quantity per unit time divided by revolutions per unit time; individual-value memory means 11.1 store an individual factor (az) and an individual summand (bz) for each cylinder (z); and, the logic device 12.1 multiplies the particular load variable for each injection device, which is common to all injection devices, by the individual factor (az) allocated to the associated cylinder and adds the associated individual summand (bz).

* * * * *

UNITED STATES PATENT AND TRADEMARK OFFICE

CERTIFICATE OF CORRECTION

PATENT NO. : 5,020,502

DATED : June 4, 1991

INVENTOR(S) : Ernst Wild

It is certified that error appears in the above-identified patent and that said Letters Patent is hereby corrected as shown below:

In column 2, line 12, ahead of "measuring" insert -- a --.

In column 6, line 26: delete "cylinder" and substitute -- cylinders -- therefor.

In column 8, line 14: delete "airfuel" and substitute -- air/fuel -- therefor.

In column 9, line 67: delete "valve" and substitute -- value -- therefor.

Signed and Sealed this

Twenty-fifth Day of May, 1993

*Attest:*

Michael K. Kirk

MICHAEL K. KIRK

*Attesting Officer*

*Acting Commissioner of Patents and Trademarks*